US008045913B2

(12) United States Patent
Jeong et al.

(10) Patent No.: US 8,045,913 B2
(45) Date of Patent: Oct. 25, 2011

(54) FASTENING DEVICE FOR OPTIONAL TRAY OF AN IMAGE FORMING APPARATUS, AN OPTIONAL TRAY, AND AN IMAGE FORMING APPARATUS

(75) Inventors: Seung-sik Jeong, Yongin-si (KR); Woo-seog Kim, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1275 days.

(21) Appl. No.: 11/384,489

(22) Filed: Mar. 21, 2006

(65) Prior Publication Data

US 2006/0291943 A1 Dec. 28, 2006

(30) Foreign Application Priority Data

Jun. 24, 2005 (KR) ..... 10-2005-0055101

(51) Int. Cl.
*G03G 15/00* (2006.01)

(52) U.S. Cl. ..... 399/393; 400/692; 400/693; 399/110

(58) Field of Classification Search ..... 400/692, 400/679, 693; 399/124, 110, 393
See application file for complete search history.

(56) References Cited

U.S. PATENT DOCUMENTS

| | | | | |
|---|---|---|---|---|
| 3,596,554 | A * | 8/1971 | Low et al. | 411/348 |
| 4,475,726 | A * | 10/1984 | Smith | 269/41 |
| 5,565,002 | A * | 10/1996 | Rawls et al. | 482/6 |
| 5,666,595 | A * | 9/1997 | Sameshima et al. | 399/110 |
| 5,797,068 | A * | 8/1998 | Otsuki et al. | 399/110 |
| 6,464,269 | B1 * | 10/2002 | Wilhelm et al. | 292/307 R |
| 6,975,831 | B2 * | 12/2005 | Kumadaki et al. | 399/393 |
| 2003/0011977 | A1 * | 1/2003 | Song et al. | 361/684 |
| 2003/0138280 | A1 * | 7/2003 | Namekawa et al. | 400/693 |
| 2005/0146591 | A1 * | 7/2005 | Ogata et al. | 347/108 |
| 2005/0163548 | A1 * | 7/2005 | Kojima | 399/393 |
| 2005/0191102 | A1 * | 9/2005 | Amagai | 399/393 |
| 2005/0232672 | A1 * | 10/2005 | Nakamura et al. | 399/405 |
| 2007/0217844 | A1 * | 9/2007 | Yasuhara et al. | 399/393 |

FOREIGN PATENT DOCUMENTS

| | | |
|---|---|---|
| CN | 2474368 Y | 1/2002 |
| JP | 59-036041 | 2/1984 |
| JP | 09-090688 | 4/1997 |
| JP | 09-110194 | 4/1997 |
| JP | 11-127293 | 5/1999 |
| JP | 11-249357 | 9/1999 |
| JP | 2003-207964 | 7/2003 |

OTHER PUBLICATIONS

Office Action issued in Korean Patent Application No. 2005-55101 on Jun. 24, 2006.
Office Action issued by Chinese Patent Office in Chinese Patent Application No. 2006100932711 on Jul. 4, 2008.

* cited by examiner

*Primary Examiner* — Judy Nguyen
*Assistant Examiner* — David Banh
(74) *Attorney, Agent, or Firm* — Staas & Halsey LLP

(57) ABSTRACT

An optional tray fastening device of an image forming apparatus, for providing a fastening connection between an optional receiving tray moving in and out with respect to a main body of the image forming apparatus and the main body when mounting the optional tray to a lower part of the main body, includes a fastening depression formed at a lower part of the main body; a connection boss that protrudes from an upper part of the optional tray to be inserted in the fastening depression; and a key member that restrains escape of the connection boss from the fastening depression.

15 Claims, 3 Drawing Sheets

FASTENING DEVICE FOR OPTIONAL TRAY OF AN IMAGE FORMING APPARATUS, AN OPTIONAL TRAY, AND AN IMAGE FORMING APPARATUS

CROSS-REFERENCE TO RELATED APPLICATIONS

This application claims the benefit of Korean Patent Application No. 2005-55101, filed Jun. 24, 2005, in the Korean Intellectual Property Office, the disclosure of which is incorporated herein by reference.

BACKGROUND OF THE INVENTION

1. Field of the Invention

Aspects of the present invention relate to an optional tray fastening device for an image forming apparatus, the optional tray, and an image forming apparatus.

2. Description of the Related Art

Generally, image forming apparatuses, which are sometimes referred to by the term "office machines" include multifunction apparatuses, photocopiers, facsimile machines, and printers. Image forming apparatuses generally comprise a main body and may have an optional tray additionally connected to a lower part of the main body.

For example, in an image forming apparatus, the main body comprises a developing unit, a fixing unit, and a laser scanning unit. In addition, a print medium supply tray for supplying a print medium such as paper to the developing unit is mounted at a lower part of the main body.

The print medium supply tray may be joined to the main body or may be separably mounted to the main body as an optional part. Recently, print medium supply trays have been configured so that a plurality of print medium trays can be layered, to supply various types of print media.

Therefore, such print medium trays usually have a layerable structure so that two or three print medium trays can be layered according to the user's demand and are separably mounted with respect to the lower part of the main body. Herein, such print medium trays are referred to as "optional print medium supply trays" or, for short, "optional trays."

More specifically, a hole is formed at the lower part of the main body or the print medium supply tray while a shaft is formed at an upper part of an optional print medium supply tray. The shaft is configured to be inserted in the hole formed at the main body. By fitting the shaft into the hole, the optional print medium supply tray can be attached to the main body or to the lower part of the print medium supply tray.

However, the above connection method using the hole and the shaft has the following problem.

Such a simple connection using a hole and the shaft prevents the optional print medium supply tray and the main body from moving laterally with respect to each other, but does not prevent the shaft from leaving the hole. Therefore, the connection can be easily released when carrying or tilting the main body with the optional print medium supply tray attached thereto. As more and more optional print medium supply trays are added, this danger increases.

SUMMARY OF THE INVENTION

An aspect of the present invention is to solve at least the above and/or other problems and disadvantages and to provide at least the advantages described below. Accordingly, an aspect of the present invention is to provide an improved optional tray fastening device (that is, a fastening device for an optional tray) for an office machine such as an image forming apparatus that provides a firm connection between a main body of the of the image forming apparatus and the optional tray. Other aspects of the present invention include the optional tray, and an image forming apparatus that comprises the optional tray.

Additional aspects and/or advantages of the invention will be set forth in part in the description which follows and, in part, will be obvious from the description, or may be learned by practice of the invention.

In order to achieve the above-described aspects of the present invention, there is provided an optional tray fastening device of an image forming apparatus that provides a releasable fastening connection between an optional tray and a lower part of a main body of the image forming apparatus, the fastening device comprising a fastening depression formed at a lower part of the main body; a connection boss protruding from an upper part of the optional tray that inserts into the fastening depression; and a key member restraining escape of the connection boss from the fastening depression.

The main body comprises a penetrating hole formed at a flank thereof. The penetrating hole is in communication with the fastening depression and allows the key member to pass therethrough, and the connection boss comprises a key hole that engages the key member when the key member has passed through the penetrating hole.

The key member may be a pin connected to the optional tray through a wire.

The key hole may penetrate the connection boss.

The optional tray fastening device may further comprise a clip member that restrains the pin from easily escaping from the key hole.

The pin includes a clip groove formed around an outer circumference thereof. The clip member includes a resilient part that engages with the connection boss and resiliently encloses the clip groove of the pin when the pin is inserted in the key hole.

The optional tray comprises a print medium supply tray for receiving print mediums to be supplied to the main body of the image forming apparatus.

Another aspect of the present invention is to provide an optional tray of an image forming apparatus. The optional tray is mounted to a lower part of the image forming apparatus. The image forming apparatus has a fastening depression formed at a lower part thereof and a penetrating hole formed at a flank thereof in communication with the fastening depression. The optional tray comprises a tray body; a print medium supply tray that is insertable into and removable from the tray body; a connection boss that protrudes from an upper part of the tray body and that inserts into the fastening depression; and a key member that restrains escape of the connection boss from the fastening depression.

The connection boss comprises a key hole that receives the key member, wherein the key member passes through the penetrating hole and inserts into the key hole.

The key member may be a cylindrical pin.

The key member may be connected to the tray body through a wire.

The optional tray may further comprise a clip member for restraining the pin from easily escaping from the key hole.

The pin comprises a clip groove formed around an outer circumference thereof, and the clip member comprises a resilient part that engages with the connection boss and resiliently encloses the clip groove.

The tray body has a fastening depression formed at a lower part thereof with a predetermined depth, and a penetrating hole formed at a flank thereof in communication with the fastening depression.

Yet another aspect of the present invention is to provide an image forming apparatus comprising a main body; a first optional tray receiving print media to be supplied to the main body and layered under the main body; and a first fastening unit restraining separation between the first optional tray and the main body.

The first fastening unit comprises a first fastening depression formed at a lower part of the main body; a first connection boss protruding from an upper part of the first optional tray facing the lower part of the main body and inserted in the first fastening depression; and a first key member restraining escape of the first connection boss from the first fastening depression.

The main body comprises a penetrating hole at a flank thereof in communication with the first fastening hole, and the first connection boss comprises a key hole that receives the key member when the key member has passed through the penetrating hole.

The first key member may be a pin connected to the first optional tray.

The image forming apparatus may further comprise a first clip member restraining the key member from easily escaping from the key hole.

The image forming apparatus may further comprise a second optional tray mounted to a lower part of the first optional tray; and a second fastening unit restraining separation between the first and the second optional trays.

The second fastening unit comprises a second fastening depression formed at the lower part of the first optional tray; a second connection boss that protrudes on an upper part of the second optional tray and that inserts into the second fastening depression; and a second key member restraining escape of the second connection boss from the second fastening depression.

The first optional tray comprises a penetrating hole at a flank thereof that communicates with the second fastening depression, and the second connection boss comprises a second key member that engages with the second key member when the second key member has passed through the penetrating hole.

The key member may be a pin connected to the second optional tray.

The image forming apparatus further comprises a second clip member restraining the pin from easily escaping from the key hole.

Yet another aspect of the present invention is to provide an image forming apparatus comprising a main body; a plurality of optional trays that receive print mediums to be supplied to the main body and that are mountable in a layered stack in any order under the main body; and a plurality of fastening units restraining separation between the main body and an optional tray adjacent to the main body or between two optional trays that are adjacent to each other. Each fastening unit may comprise a fastening depression formed at a lower part of the main body or a lower part of an optional tray; a one projection boss protruding from an upper part of an optional tray facing the lower part of the main body or the lower part of another one of the optional trays and inserted in the fastening depression; and a first key member restraining escape of the connection boss from first fastening depression.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
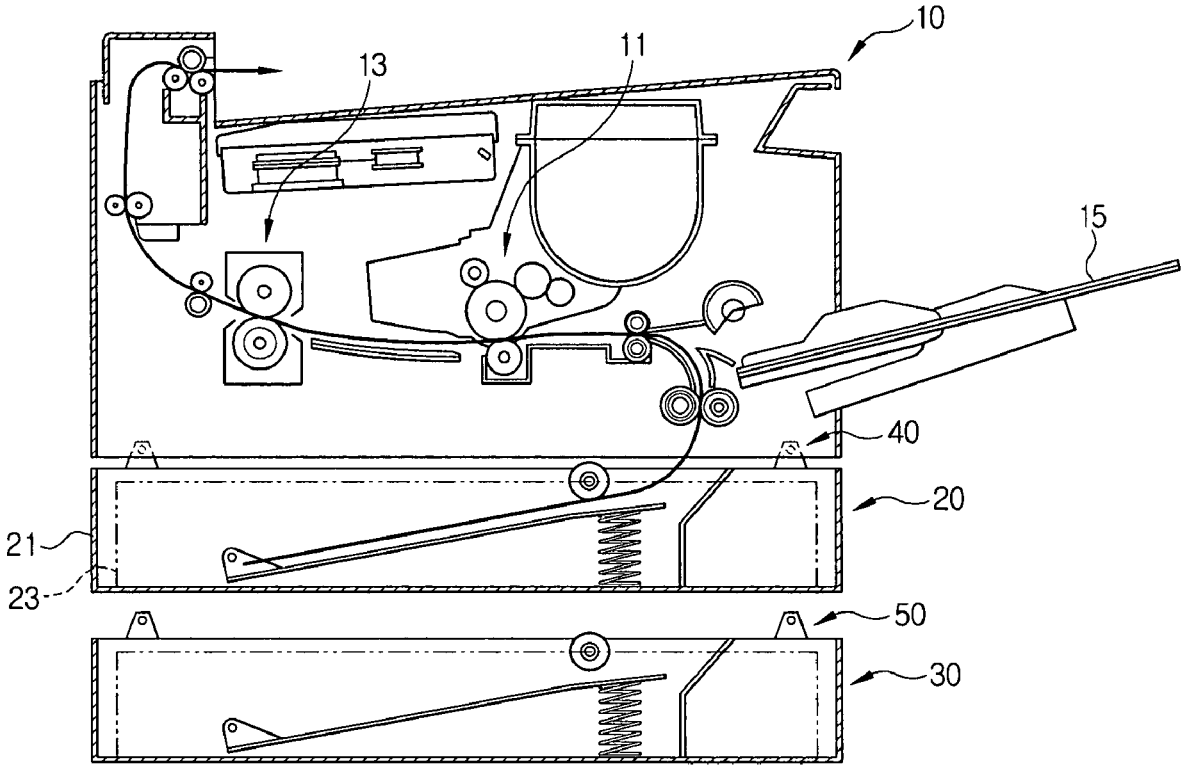
FIG. 1 is a side view schematically showing the structure of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures. The matters defined in the description, such as a detailed construction and elements, are only provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
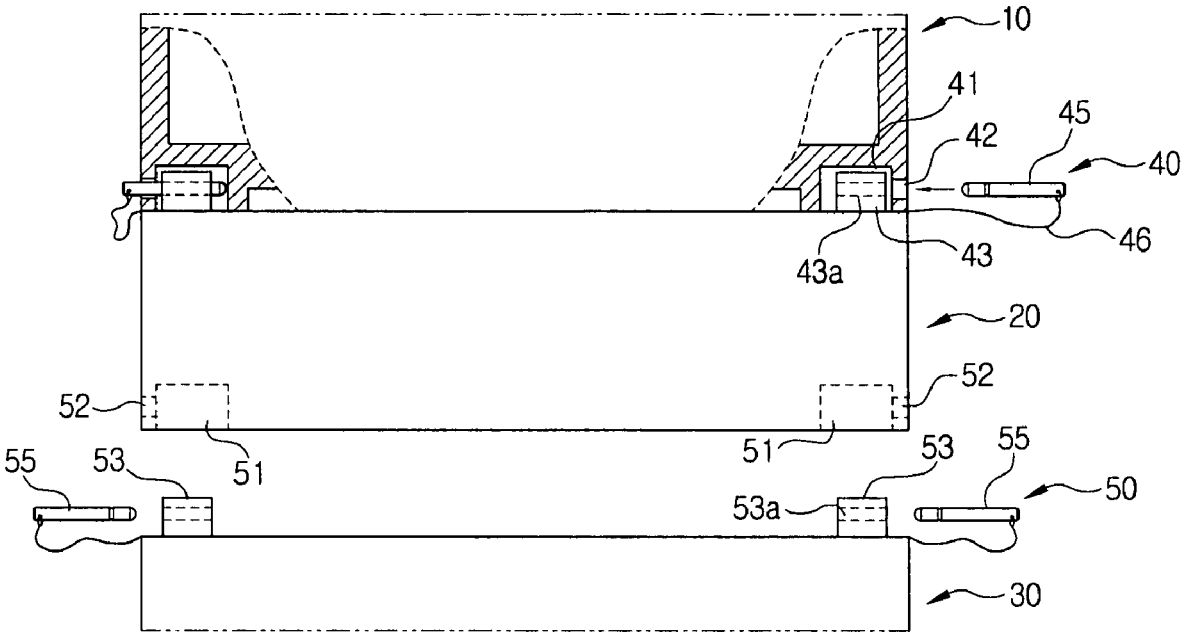
FIG. 2 is a sectional view showing aspects of the image forming apparatus, turned 90° from the side view of FIG. 1.

As an example of an office machine, FIG. 1 and FIG. 2 schematically show an image forming apparatus for generating an image on a print medium such as paper. Referring to FIGS. 1 and 2, the image forming apparatus comprises a main body 10, first and second optional trays 20 and 30 mounted in layers to a lower part of the main body 10, a first fastening unit 40 that connects the first optional tray 20 and the main body 10, and a second fastening unit 50 that connects the first and the second optional trays 20 and 30. The second optional tray 30 is shown as detached from the first optional tray in order to show the second fastening unit more clearly.

The main body 10 includes therein a developing unit 11 that develops an image on the print medium and a fixing unit 13 that fixes the image on the print medium as the print medium passes through the developing unit 11. Although not illustrated, it should be understood that the main body 10 further comprises various other parts relating to image formation. Additionally, the main body 10 may be provided with a paper supply stacker 15 that supplies manually fed print media to be used for printing.

The first optional tray 20 is selectively attached to a lower part of the main body 10 and holds print media. The first optional tray 20 comprises a tray body 21, and a paper supply tray 23 mounted in the tray body 21. The paper supply tray 23 can be inserted into and removed from the tray body 21. When the above-structured first optional tray 20 is in use, the main body 10 of the image forming apparatus is located on the first optional tray 20.

The first fastening unit 40 is disposed between the first optional tray 20 and the main body 10 to prevent separation between the main body 10 and the first optional tray 20. The first fastening unit 40 comprises a first fastening depression 41 formed at the lower part of the main body 10, a first connection boss 43 that protrudes from an upper part the first optional tray 20, and a first key member 45 restraining escape of the first connection boss 43 from the first fastening depression 41.

The first fastening depression 41 is formed at the lower part of the main body 10 with a predetermined depth. A first penetrating hole 42 is formed at a flank of the main body 10, in communication with the first fastening depression 41.

In addition, a first key hole 43*a* for inserting therein the first key member 45 is provided to the first connection boss 43.

The first key member 45 is preferably formed as a cylindrical pin which is connected to the tray body 21 through a wire 46. Since the first key member 45 engages with the first key hole 43*a* of the first connection boss 43, when it has been passed through the first penetrating hole 42 formed at the main body 10, escape of the first connection boss 43 from the first fastening depression 41 can be prevented. FIG. 2 shows the first fastening unit 40 wherein the first key member 45 has not yet been inserted into the first key hole 43*a* and also shows another fastening unit between the main body 10 and the first optional tray 20 wherein the key member has been inserted into the key hole.

Figure 4:
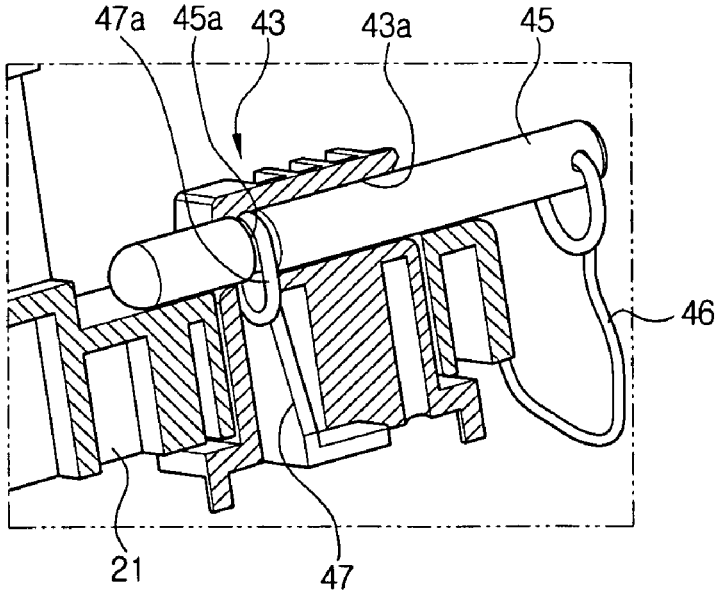
FIG. 4 is a perspective view showing a fastening unit.

As shown in FIG. 4, a clip member 47 is further provided in order to restrain the first key member 45 from easily escaping from the first key hole 43*a* of the first connection boss 43. The clip member 47 is supported by the first connection boss 43 and has a resilient part 47*a* that resiliently encloses the first key member 45 when the first key member 45 is inserted in the first key hole 43*a*.

A clip groove 45*a* is formed around an outer circumference of the first key member 45 and is enclosed resiliently by the resilient part 47*a*. The first key member 45 is preferably made of a metal having a high degree of strength. The clip member 47 may be formed of plastic or metal.

Figure 3:
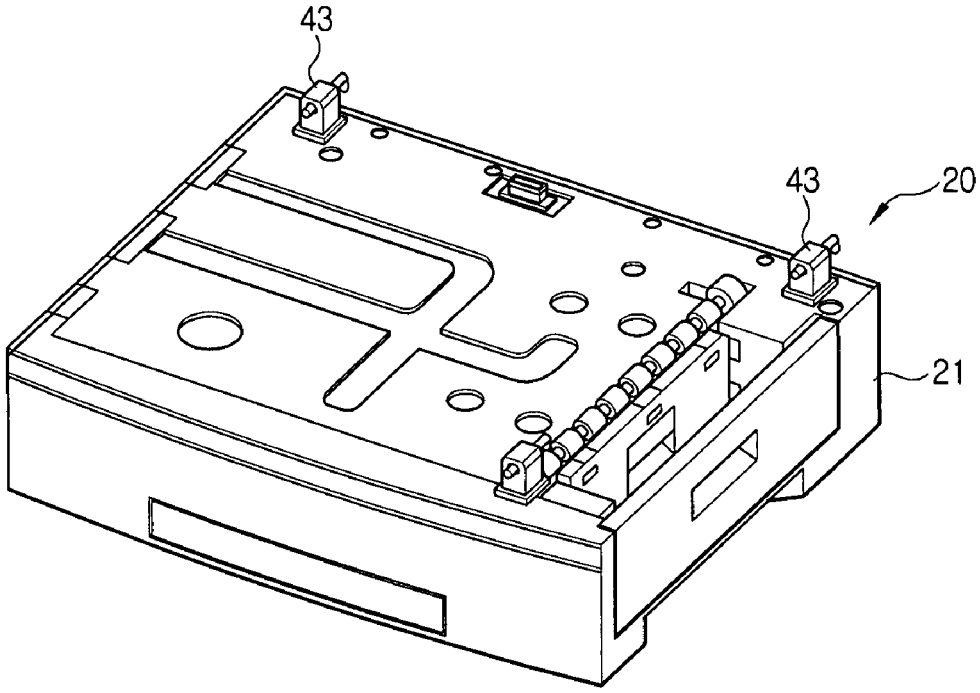
FIG. 3 is a perspective view showing an optional tray.

As shown in FIG. 3, a plurality of the first connection bosses 43 protrude from an upper part of the tray body 21. Each of the first connection bosses 43 is positioned corresponding to the first fastening depression 41. Preferably, the first connection boss 43 is disposed in the vicinity of each corner of the upper part of the tray body 21, although other arrangements may be used. As shown in FIG. 4, the first connection boss 43 may be separately manufactured and connected to the tray body 21. Otherwise, the first connection boss 43 can be formed integrally with the tray body 21.

As shown in FIG. 2, the image forming apparatus may also include a second optional tray 30. The second fastening unit 50 may have the same structure as the first fastening unit and restrains separation between the first optional tray 20 and the second optional tray 30. The second fastening unit 50 comprises a second fastening depression 51 formed at a lower part of the first optional tray 20, a second connection boss 53 that protrudes from an upper part of the second optional tray 30, and a second key member 55 that restrains escape of the second connection boss 53 from the second fastening depression 51. In addition, a second penetrating hole 52 is formed at a flank of the first optional tray 20, in communication with the second fastening depression 51.

The second connection boss 53 has a second key hole 53*a* for inserting therein the second key member 55 when the second key member has passed through the second penetrating hole 52.

Since the second key member 55 has the same structure and function as the first key member 45, a detailed description thereof will be omitted herein. Also, it is to be understood that the second connection boss 53 may have a clip member (not shown) having the same structure as one shown in FIG. 4.

A plurality of the second fastening depressions 51 are provided at the lower part of the second optional tray 20 and a plurality of the second connection bosses 53 are provided to correspond to the second fastening depressions 53. Preferably, the second connection boss 53 is disposed in the vicinity of each corner of the upper part of the second optional tray 30, although other arrangements may be used. Further, the second optional tray may itself include fastening depressions (not shown) so that another optional tray may be attached to second optional tray, with fastening units having the same structure as the first fastening unit 40 and the second fastening units 50.

In the above-configured image forming apparatus, when only the first optional tray 20 is mounted to the lower part of the main body 10, the first fastening unit 40 is able to prevent separation between the first optional tray 20 and the main body 10. Therefore, the main body 10 can be moved or tilted conveniently without separation between the main body 10 and the first optional tray 20.

When adding the second optional tray 30 or even third and fourth optional trays (not shown) in a layered manner, separation between the respective trays can be prevented by applying the same structure as the second fastening unit 50 between the respective trays.

Furthermore, connections between the optional trays 20 and 30 or between the first optional tray 20 and the main body 10 can be simply released by withdrawing the key members 45 and 55 from the connection bosses 43 and 53.

Although only the first and the second optional trays 20 and 30 are employed in this embodiment, this is only by way of example. Therefore, the present invention can be applied to a structure comprising more optional trays, regardless of the number of optional trays. Moreover, a plurality of fastening units on a plurality the optional trays may be provided with a compatible alignment and arrangement so that the optional trays may be stacked in any order desired by a user. For example, the second optional tray may be mounted directly on the main body and then, the first optional tray may be mounted to the second optional tray, etc.

As can be appreciated from the above description of the optional tray fastening device, the optional tray, and the image forming apparatus, according to the embodiment of the present invention, in an office machine such as an image forming apparatus, a connection between the main body of the image forming apparatus and the optional tray or between the optional trays can be securely fastened. Accordingly, even when the image forming apparatus is moved or tilted, such connections among the main body and the optional trays can be prevented from being released.

In addition, since the key member is resiliently supported by the clip member, operation of the key member can be achieved through a simple linear motion.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a main body;

an optional tray that is mountable to a lower part of the image forming apparatus, a fastening depression formed at a lower part of the main body of the image forming apparatus and a penetrating hole formed at a flank thereof in communication with the fastening depression, wherein the optional tray comprises a tray body;

a print medium supply tray that is insertable into and removable from the tray body;

a connection boss that protrudes from an upper part of the tray body and that inserts into the fastening depression;

a key member that restrains escape of the connection boss from the fastening depression;

a key hole formed in connection boss that receives the key member, the key member passing through the penetrating hole and being inserted into the key hole; and a clip member to restrain the key member from escaping from the key hole, wherein the key member comprises a clip groove formed around an outer circumference thereof, and the clip member comprises a resilient part that engages with the connection boss and resiliently encloses the clip groove.

2. The image forming apparatus of claim 1, wherein the key member is a cylindrical pin.

3. The image forming apparatus of claim 2, wherein the key member is connected to the tray body with a wire.

4. The image forming apparatus of claim 1, wherein the tray body has a fastening depression with a predetermined depth formed at a lower part thereof, and a penetrating hole formed at a flank thereof in communication with the fastening depression.

5. An image forming apparatus comprising:

a main body, the main body including a penetrating hole at a flank thereof;

a first optional tray that receives print media to be supplied to the main body and that is mounted under the main body; and a first fastening unit restraining separation between the first optional tray and the main body, wherein the first fastening unit comprises a first fastening depression formed at a lower part of the main body corresponding to the penetrating hole;

a first connection boss protruding from an upper part of the first optional tray facing the lower part of the main body and inserted in the first fastening depression;

a first key member restraining escape of the first connection boss from the first fastening depression, the first connection boss including a key hole that receives the first key member when the first key member has passed through the penetrating hole; and a first clip member to restrain the first key member from escaping from the first key hole, wherein the first key member comprises a clip groove formed around an outer circumference thereof, and the first clip member comprises a resilient part that engages with the connection boss and resiliently encloses the clip groove of the first key member when the first key member is inserted in the first key hole.

6. The image forming apparatus of claim 5, wherein the first key member is a pin connected to the first optional tray.

7. The image forming apparatus of claim 5, further comprising:

a second optional tray mounted to a lower part of the first optional tray; and a second fastening unit restraining separation between the first and the second optional trays.

8. The image forming apparatus of claim 7, wherein the second fastening unit comprises:

a second fastening depression formed at the lower part of the first optional tray;

a second connection boss that protrudes from an upper part of the second optional tray and that inserts into the second fastening depression; and a second key member restraining escape of the second connection boss from the second fastening depression.

9. The image forming apparatus of claim 8, wherein the first optional tray comprises a penetrating hole at a flank thereof that communicates with the second fastening depression, and the second connection boss comprises a second key hole that engages the second key member when the second key member has passed through the penetrating hole.

10. The image forming apparatus of claim 9, wherein the second key member is a pin connected to the second optional tray.

11. The image forming apparatus of claim 10, further comprising a second clip member restraining the pin from escaping from the key hole.

12. An image forming apparatus comprising:

a main body, the main body including a penetrating hole at a flank thereof;

a plurality of optional trays that receive print media to be supplied to the main body and that are mountable in a layered stack under the main body; and a plurality of fastening units restraining separation between the main body and an optional tray adjacent to the main body or between two optional trays that are adjacent to each other, wherein each fastening unit comprises a fastening depression formed at a lower part of the main body or a lower part of an optional tray corresponding to the penetrating hole;

a connection boss protruding from an upper part of an optional tray facing the lower part of the main body or the lower part of another one of the optional trays and inserted in the fastening depression;

a first key member restraining escape of the connection boss from the first fastening depression, the first connection boss including a key hole that receives the first key member when the first key member has passed through the penetrating hole; and a first clip member to restrain the first key member from escaping from the first key hole, wherein the first key member comprises a clip groove formed around an outer circumference thereof, and the first clip member comprises a resilient part that engages with the connection boss and resiliently encloses the clip groove of the first key member when the first key member is inserted in the first key hole.

13. The image forming apparatus of claim 12, wherein the plurality of fastening units restraining separation between the main body and an optional tray adjacent to the main body or between two optional trays that are adjacent to each other are arranged such that the optional trays may be mountable in a layered stack under the main body in any order.

14. The image forming apparatus of claim 5, wherein the optional tray comprises a tray body and a print medium supply tray that is insertable into and removable from the tray body and wherein the connection boss protrudes from an upper part of the tray body.

15. The image forming apparatus of claim 12, wherein the optional trays each comprise a tray body and a print medium supply tray that is insertable into and removable from the tray body and wherein the connection boss protrudes from an upper part of the tray body.

* * * * *